US011094263B2

(12) United States Patent
Kim et al.

(10) Patent No.: US 11,094,263 B2
(45) Date of Patent: Aug. 17, 2021

(54) DISPLAY DEVICE DRIVING METHOD

(71) Applicant: Samsung Display Co., Ltd., Yongin-si (KR)

(72) Inventors: Yu Chol Kim, Yongin-si (KR); Jin Wook Yang, Yongin-si (KR); Ji Hye Kim, Yongin-si (KR); Young Ha Sohn, Yongin-si (KR); Jae Hyeon Jeon, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/890,328

(22) Filed: Jun. 2, 2020

(65) Prior Publication Data

US 2021/0065628 A1 Mar. 4, 2021

(30) Foreign Application Priority Data

Aug. 30, 2019 (KR) ..... 10-2019-0107145

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); *G09G 2300/0876* (2013.01)

(58) Field of Classification Search
CPC ..... G09G 2320/02
See application file for complete search history.

(56) References Cited

U.S. PATENT DOCUMENTS

| | | | | |
|---|---|---|---|---|
| 8,912,989 | B2 | 12/2014 | Chung et al. | |
| 9,013,375 | B2 | 4/2015 | Yoo | |
| 9,189,992 | B2 | 11/2015 | Hwang et al. | |
| 9,978,311 | B2 * | 5/2018 | Hwang | G09G 3/3258 |
| 10,522,100 | B2 * | 12/2019 | Jeong | G09G 3/3607 |
| 10,692,434 | B2 * | 6/2020 | Zhang | G09G 3/3266 |
| 2011/0164071 | A1 * | 7/2011 | Chung | G09G 3/3233 345/690 |
| 2015/0187273 | A1 * | 7/2015 | Chang | G09G 3/3233 345/690 |
| 2018/0006263 | A1 * | 1/2018 | Yoon | G09G 3/3233 |
| 2020/0243013 | A1 * | 7/2020 | Wang | G09G 3/3233 |

FOREIGN PATENT DOCUMENTS

| | | | |
|---|---|---|---|
| KR | 10-2010-0072433 | A | 7/2010 |
| KR | 10-2014-0139327 | A | 12/2014 |
| KR | 10-1717986 | B1 | 3/2017 |
| KR | 10-1860860 | B1 | 7/2018 |
| KR | 10-2019-0022446 | A | 3/2019 |

* cited by examiner

*Primary Examiner* — Sepehr Azari
(74) *Attorney, Agent, or Firm* — Lewis Roca Rothgerber Christie LLP

(57) ABSTRACT

A display device driving method includes: providing a reference voltage for compensating a threshold voltage of a driving transistor in a pixel; and providing a data signal to the pixel, wherein providing the reference voltage, and providing the data signal to the pixel are performed in a first frame period, and a second frame period successive to the first frame period, wherein the display device driving method further comprises providing a compensation signal generated by comparing a data signal with a reference voltage provided in a previous frame period of each frame period to the pixel before providing the reference voltage is ended.

20 Claims, 12 Drawing Sheets

DISPLAY DEVICE DRIVING METHOD

CROSS-REFERENCE TO RELATED APPLICATION

The present application claims priority to and the benefit of Korean Patent Application No. 10-2019-0107145, filed on Aug. 30, 2019, the entire content of which is herein incorporated by reference.

BACKGROUND

1. Field

Aspects of some example embodiments of the present disclosure relate to a display device driving method.

2. Description of the Related Art

An organic light emitting display device displays an image using an organic light emitting diode (OLED), which is a self-luminous element of which a luminance is controlled by a current or a voltage.

In an organic light emitting display device, a pixel generally includes a plurality of transistors, a storage capacitor, and an organic light emitting diode. A difference of a luminance may occur between the various pixels in a display device due to various deviations (for example, a distribution of a threshold voltage of a driving transistor) between the pixels, and the luminance difference may be visually recognized or perceived by users (e.g., as a spot or defect in the displayed image). In order to correct the spot, various spot compensation algorithms may be utilized. For example, a method of correcting a spot by compensating for a threshold voltage of a driving transistor for every frame period when the organic light emitting display is driven may be used.

Meanwhile, as a resolution of an organic light emitting diode display device increases, a time for compensating for the threshold voltage of the driving transistor may be reduced. In order to compensate for the threshold voltage based on a data signal, the number of data lines may be increased to extend the compensation time.

The above information disclosed in this Background section is only for enhancement of understanding of the background and therefore the information discussed in this Background section does not necessarily constitute prior art.

SUMMARY

Aspects of some example embodiments of the present disclosure may include a method of driving a display device, which is connected to one data line for each pixel and has a sufficiently secured time for compensating for a threshold voltage of a driving transistor.

The characteristics of the disclosure are not limited to the above-described characteristics, and other technical characteristics which are not described may be more clearly understood by those skilled in the art from the following description.

A display device driving method according to some example embodiments of the disclosure for resolving the characteristics described above includes providing a reference voltage for compensating a threshold voltage of a driving transistor in a pixel; and providing a data signal to the pixel, wherein providing the reference voltage, and providing the data signal to the pixel are performed in a first frame period, and a second frame period successive to the first frame period, wherein the display device driving method further comprises providing a compensation signal generated by comparing a data signal with a reference voltage provided in a previous frame period of each frame period to the pixel before providing the reference voltage is ended.

According to some example embodiments, the display device driving method may further include providing an initialization voltage to the pixel to initialize a voltage level of a gate electrode of the driving transistor, which is performed during each frame period.

According to some example embodiments, the display device driving method may further include providing the initialization voltage, providing the reference voltage, and providing the data signal may be sequentially started, in each frame period.

According to some example embodiments, the display device driving method may further include providing the compensation signal may be performed after providing the initialization voltage is started, in each frame period.

According to some example embodiments, the display device driving method may further include providing the initialization voltage and providing the reference voltage may be non-overlapped in time, in each frame period.

According to some example embodiments, a length of time during which providing the reference voltage is performed and a length of time during which providing the data signal is performed may be different from each other, in each frame period.

According to some example embodiments, the data signal and the compensation signal may be provided through the same data line.

According to some example embodiments, a process of generating the compensation signal provided in the second frame period may include comparing the reference voltage provided in the first frame period with a magnitude of the data signal, and determining a compensation signal to be provided in the second frame period.

According to some example embodiments, determining the compensation signal may include determining the compensation signal by calculating the data signal provided in the first frame period and a compensation value.

According to some example embodiments, the compensation value may be determined by calculating a first parameter provided from a look-up table and a second parameter generated by comparing the reference voltage with the magnitude of the data signal, and the calculation may include multiplication.

According to some example embodiments, the pixel may include a pixel circuit connected to first power voltage supply line and a second power voltage supply line providing a power voltage, a plurality of scan lines providing a scan signal, a data line providing the data signal, and a reference voltage supply line providing the reference voltage, and an organic light emitting diode connected to the pixel circuit.

According to some example embodiments, the pixel circuit may include a plurality of transistors and a plurality of capacitors.

According to some example embodiments, one capacitor among the plurality of capacitors may charge a gate electrode of the driving transistor to a voltage corresponding to the data signal.

According to some example embodiments, a voltage level of both electrodes of the one capacitor may be the same after providing the compensation signal.

According to some example embodiments, the plurality of transistors may include a first transistor having a source/drain electrode connected between the first power voltage supply line and an anode electrode of the organic light emitting diode, and a gate electrode connected to a second node, and a second transistor having a source/drain electrode connected between the data line and a first node, and a gate electrode connected to a first scan line among the plurality of scan lines, and the plurality of capacitors may include a first capacitor connected between the first power voltage supply line and the first node, and a second capacitor connected between the first node and the second node.

According to some example embodiments, the plurality of transistors may further include a third transistor having a source/drain electrode connected to the first node and the reference voltage supply line, and a gate electrode connected to a second scan line among the plurality of scan lines.

A display device driving method according to some example embodiments of the disclosure for resolving the characteristics described above includes providing a reference voltage for compensating a threshold voltage of a driving transistor in a pixel, which is performed in a first frame period, providing a data signal to the pixel through a data line, which is performed in the first frame period, and generating a compensation signal provided to the pixel in a second frame period successive to the first frame period by comparing the reference voltage provided in the first frame period with the data signal.

According to some example embodiments, the compensation signal may be received in the second frame period, and a voltage of both ends of a capacitor connected to a gate electrode of the driving transistor may become zero.

According to some example embodiments, the display device driving method may further include providing the compensation signal through the data line before providing the reference voltage in the second frame period is ended, after generating the compensation signal.

A display device driving method according some example embodiments of the disclosure for resolving the characteristics described above includes providing a reference voltage for compensating a threshold voltage of a driving transistor in a pixel, which is performed in a first frame period, providing a data signal to the pixel through a data line, which is performed in the first frame period, and determining a voltage level of the reference voltage provided to the pixel in a second frame period successive to the first frame period by comparing the reference voltage provided in the first frame period with the data signal. A voltage level of the reference voltage provided in the first frame period and a voltage level of the reference voltage provided in the second frame period may be different from each other.

Further details of other example embodiments are included in the detailed description and drawings.

According to some example embodiments of the disclosure, the time for compensating for the threshold voltage of the driving transistor may be sufficiently secured without increasing the number of data lines by the display device driving method.

The characteristics of embodiments according to the present disclosure are not limited to the characteristics described above, more various effects are included in the present specification.

BRIEF DESCRIPTION OF THE DRAWINGS

The above and other characteristics of the invention will become more apparent by describing in further detail aspects of some example embodiments thereof with reference to the accompanying drawings, in which.

DETAILED DESCRIPTION

Figure 1:
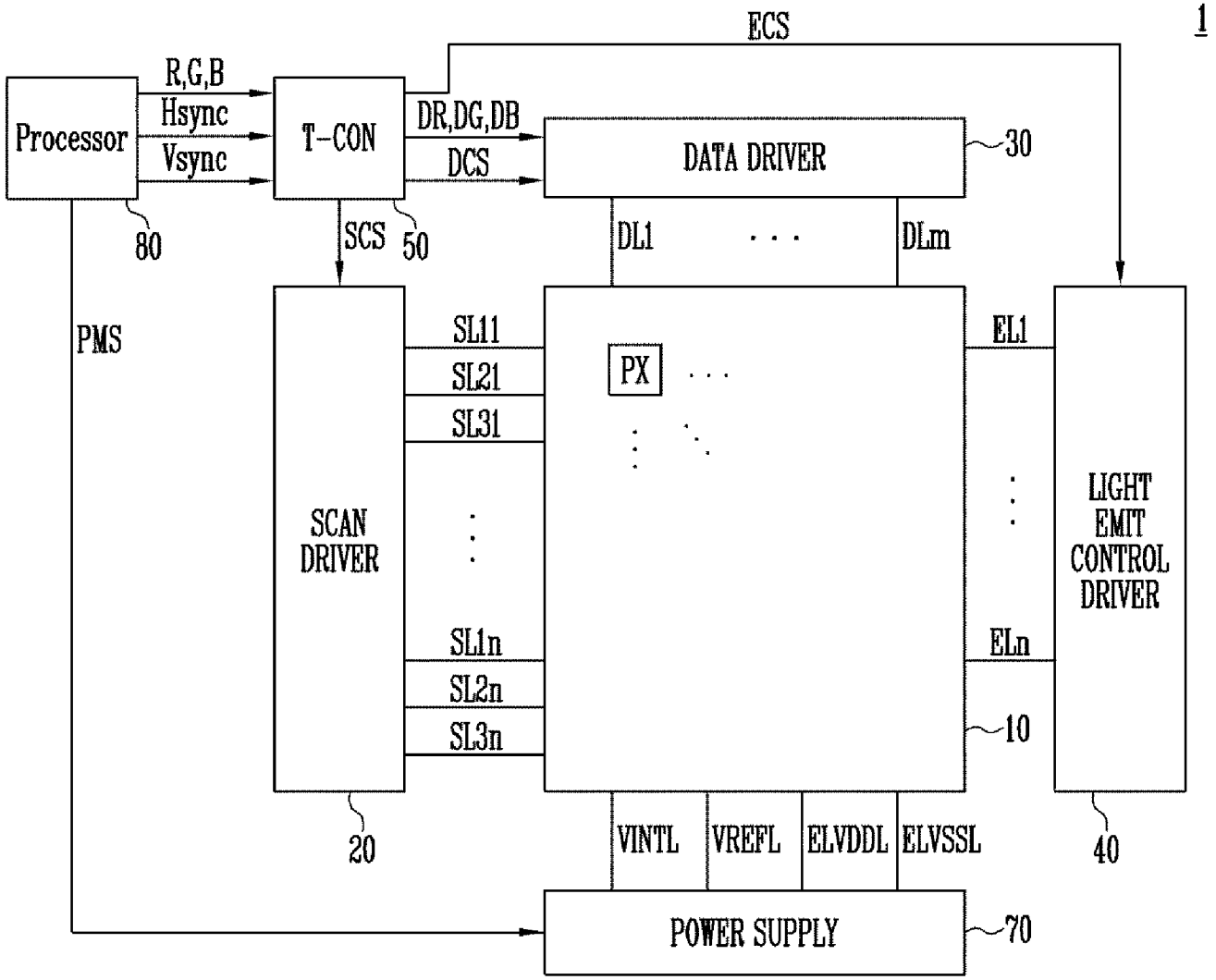
FIG. 1 is a block diagram schematically illustrating a display device according to some example embodiments of the disclosure.

The characteristics and features of embodiments according to the present disclosure and a method of achieving them will become more apparent with reference to the example embodiments described in detail below together with the accompanying drawings. However, the disclosure is not limited to the example embodiments disclosed below, and may be implemented in various different forms. The present example embodiments are provided so that the disclosure will be more thorough and more complete and those skilled in the art to which the disclosure pertains can more fully understand the scope of the disclosure. Embodiments according to the disclosure are y defined by the scope of the claims and their equivalents.

Although a first, a second, and the like are used to describe various components, these components are not limited by these terms. These terms are used only to distinguish one component from another component. Therefore, a first component mentioned below may be a second component within the technical spirit of the disclosure. The singular expressions include plural expressions unless the context clearly dictates otherwise.

Hereinafter, example embodiments of the disclosure will be described in more detail with reference to the accompanying drawings. The same or similar reference numerals are used for the same components in the drawings.

Figure 2:
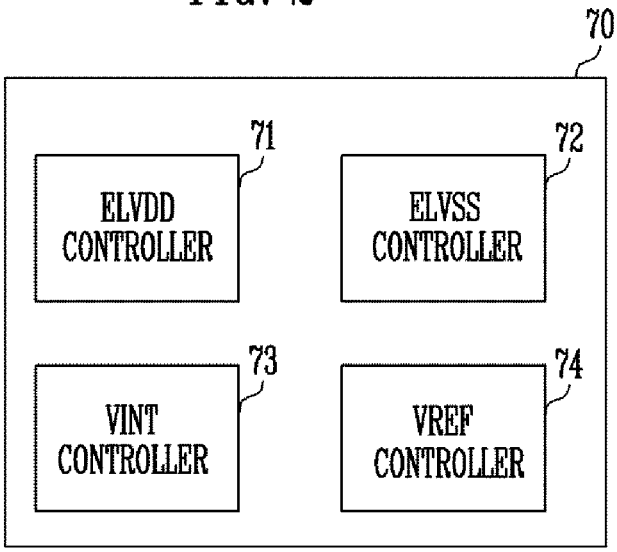
FIG. 2 is a block diagram schematically illustrating a power supply in the display device according to some example embodiments of the disclosure.

FIG. 1 is a block diagram schematically illustrating a display device according to some example embodiments of the disclosure. FIG. 2 is a block diagram schematically illustrating a power supply in the display device according to some example embodiments of the disclosure.

Referring to FIG. 1, the display device 1 according to some example embodiments of the disclosure includes a display unit 10, a scan driver 20, a data driver 30, a light emit control driver 40, a timing controller 50, a power supply 70, and a processor 80.

The display device 1 is a device that displays moving images (e.g., video images) or still images (e.g., static images) or a device that displays stereoscopic images, and may be used various products such as a television, a notebook computer, a monitor, an advertisement board, and the Internet of things as well as a portable electronic device such as a mobile communication terminal, a smart phone, a tablet, a smart watch and a navigation system.

Hereinafter, an organic light emitting display device will be described as an example of the display device 1. However, the disclosure is not limited thereto and embodiments according to the present disclosure may include or be applied to other display devices such as quantum dot organic light emitting display devices, liquid crystal display devices, field emission display devices, or electrophoretic devices, unless the spirit of the disclosure is changed.

The display unit 10 includes a plurality of pixels PX positioned in an intersection portion of a plurality of scan lines SL11 to SL1*n*, SL21 to SL2*n*, and SL31 to SL3*n* (n is an integer greater than 1), a plurality of data lines DL1 to DLm (m is an integer greater than 1), and a plurality of light emission control lines EL1 to ELn and arranged in a matrix form. Each pixel PX includes a pixel circuit and a light emitting element connected to the pixel circuit. According to some example embodiments, the light emitting element may be an organic light emitting diode (refer to ID' of FIG. 3).

The plurality of pixels PX may define a light emission area emitting a plurality of colors. According to some example embodiments, the plurality of pixels PX may define light emission areas emitting light of red, green, or blue. According to some example embodiments, the pixel PX may define a light emission area emitting light of a color such as white, magenta, cyan, or the like in addition to the above-described color.

Each of the plurality of pixels PX receives a first power voltage (refer to 'ELVDD' of FIG. 3) through a first power voltage supply line ELVDDL and a second power voltage (refer to 'ELVSS' of FIG. 3) through a second power voltage supply line ELVSSL. The first power voltage may be a high level voltage (e.g., a set or predetermined high level voltage), and the second power voltage may be a low level voltage (e.g., a set or predetermined low level voltage) lower than the first power voltage.

Each of the plurality of pixels PX emits light of a luminance (e.g., a set or predetermined luminance) by a driving current supplied to the light emitting element according to a data signal (refer to DATA' of FIG. 3) transferred through the plurality of data lines DL1 to DLm.

The plurality of scan lines SL11 to SL1*n*, SL21 to SL2*n*, and SL31 to SL3*n* and the plurality of light emission control lines EL1 to ELn may extend in a row direction (a horizontal direction on the drawing), and the plurality of data lines DL1 to DLm may extend in a column direction (a vertical direction on the drawing). The row direction and the column direction may be interchanged. According to some example embodiments, each of the first power voltage supply line ELVDDL, the second power voltage supply line ELVSSL, an initialization voltage supply line VINTL, and a reference voltage supply line VREFL may extend in the row direction or the column direction.

However, the extension direction of the above-described lines is not limited thereto, and the extension direction may be variously modified.

The processor 80 supplies a control signal to the timing controller 50. For example, the control signal may include a vertical synchronization signal Vsync, a horizontal synchronization signal Hsync, a plurality of image signals R, G, and B, a data enable signal, a clock signal, and the like.

The processor 80 supplies a power control signal PMS to the power supply 70. For example, the power control signal PMS may include a control signal for allowing the power supply 70 to adjust respective voltage levels of the first power voltage, the second power voltage, the initialization voltage, and the reference voltage.

For example, the processor 80 may be implemented as a processor capable of controlling an operation of an integrated circuit (IC), an application processor (AP), a mobile AP, or the timing controller 50.

The scan driver 20 generates three scan signals (refer to 'SCAN1, SCAN2, and SCAN3' of FIG. 3) and transfers the three scan signals to each pixel PX through the plurality of scan lines SL11 to SL1*n*, SL21 to SL2*n*, and SL31 to SL3*n*. That is, the scan driver 20 sequentially supplies the respective scan signals to first scan lines SL11 to SL1*n*, second scan lines SL21 to SL2*n*, and third scan lines SL31 to SL3*n*.

The data driver 30 transfers a data signal to each pixel PX through the plurality of data lines DL1 to DLm. The data signal is supplied to a pixel PX selected by the third scan signal whenever a third scan signal (refer to 'SCAN3' of FIG. 3) is supplied to the third scan line SL31 to SL3*n*.

The light emit control driver 40 generates a light emission control signal (refer to 'EM' of FIG. 3) and transfers the light emission control signal to each pixel through the light emission control lines EL1 to ELn. The light emission control signal controls a light emission time of the pixel PX. The light emit control driver 40 may be omitted when the scan driver 20 generates not only the scan signal but also the light emission control signal, or according to an internal structure of the pixel PX. According to some example embodiments, the light emit control driver 40 may be included in the scan driver 20.

The timing controller 50 converts the plurality of image signals R, G, and B transferred from the processor 80 into a plurality of image data signals DR, DG, and DB, and transmits the plurality of image data signals DR, DG, and DB to the data driver 30. In addition, the timing controller 50 receives the vertical synchronization signal Vsync and the horizontal synchronization signal Hsync, generates a control signal for controlling driving of the scan driver 20, the data driver 30, and the light emit control driver 40, for example, a scan driving control signal SCS for controlling the scan driver 20, a data driving control signal DCS for controlling the data driver 30, a light emission driving control signal ECS for controlling the light emit control driver 40, and the power control signal PMS for controlling the power supply 70, and transfers the scan driving control signal SCS, data driving control signal DCS, light emission driving control signal ECS, and the power control signal PMS to the scan driver 20, the data driver 30, the light emit control driver 40, and the power supply 70, respectively.

In addition to the first power voltage and the second power voltage, the initialization voltage (refer to 'VINT' of FIG. 3) and the reference voltage (refer to 'VREF' of FIG. 3), which will be described in more detail later may be supplied from the power supply 70.

The power supply 70 may receive an external input voltage, and provide a power voltage to an output terminal by converting the external input voltage according to the power control signal PMS provided from the processor 80. For example, the power supply 70 may receive the external input voltage from a battery or the like, and boost the external input voltage to generate a power voltage that is higher than the external input voltage. For example, the power supply 70 may be configured of a power management integrated chip (PMIC). For example, the power supply 70 may be configured as an external DC/DC IC.

Referring to FIG. 2, the power supply 70 may include a first power voltage controller 71, a second power voltage controller 72, an initialization voltage controller 73, and a reference voltage controller 74. According to some example embodiments, the power supply 70 may be implemented in a merged form in which the first power voltage controller 71, the second power voltage controller 72, the initialization voltage controller 73, and the reference voltage controller 74 are mounted or integrated into one electronic part or component. For example, when the display device 1 is applied to a portable electronic device, the power supply 70 may be implemented in a merge type (e.g., an integrated component, as described above). However, when the display device 1 is applied to a large device such as a television, a notebook computer, a monitor, an advertisement board, or the Internet of things, the first power voltage controller 71, the second power voltage controller 72, the initialization voltage controller 73, and the reference voltage controller 74 may be implemented in independent or separate components.

The first power voltage controller 71, the second power voltage controller 72, the initialization voltage controller 73, and the reference voltage controller 74 may adjust voltage levels of the first power voltage, the second power voltage, the initialization voltage, and the reference voltage, which are output to the outside of the power supply 70, respectively.

Figure 3:
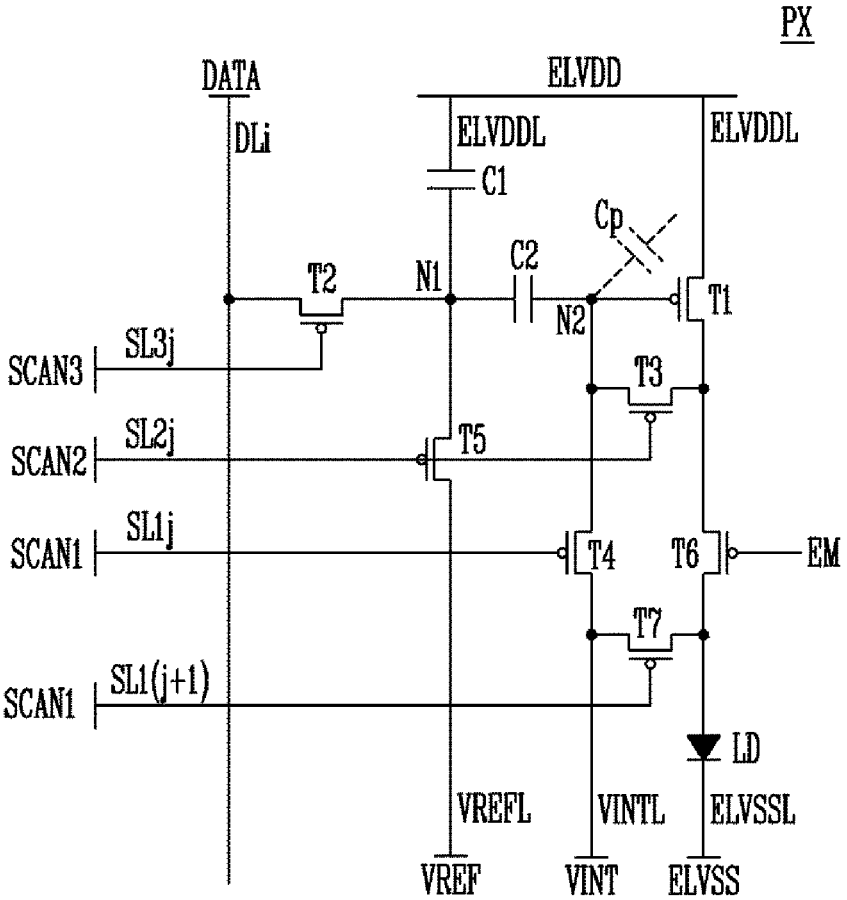
FIG. 3 is an equivalent circuit diagram of one pixel in the display device according to some example embodiments of the disclosure.

FIG. 3 is an equivalent circuit diagram of one pixel in the display device according to some example embodiments of the disclosure.

Referring to FIG. 3, the pixel PX includes the pixel circuit and the organic light emitting diode LD connected to the pixel circuit. Hereinafter, a pixel PX in which the pixel circuit is connected to a j-th first scan line SL1*j* (here, $1 \leq j \leq n$), a j-th second scan line SL2*j*, a j-th third scan line SL3*j*, an i-th data line DLi (here, $1 \leq i \leq m$), and a j-th light emission control line will be described in more detail as an example.

The pixel circuit controls an amount of a current of a driving current supplied to the organic light emitting diode LD. To this end, the pixel circuit may include a first transistor T1, a second transistor T2, a third transistor T3, a fourth transistor T4, a fifth transistor T5, a sixth transistor T6, a seventh transistor T7, a first capacitor C1, and a second capacitor C2.

A first electrode of the first transistor T1 is connected to the first power voltage supply line ELVDDL, and a second electrode is connected to a first electrode of the sixth transistor T6. In addition, a gate electrode of the first transistor T1 is connected to a second node N2. According to some example embodiments, the first transistor T1 may be a driving transistor. In the present specification, any one of a first electrode and a second electrode of the transistors T1 to T7 may be an input terminal and the other may be an output terminal. That is, any one of the first electrode and the second electrode of the transistors T1 to T7 may be a source electrode of the transistors T1 to T7, and the other may be a drain electrode.

The first transistor T1 may control a current flowing through the organic light emitting diode LD according to a gate-source voltage (threshold voltage). The first transistor T1 may control the current supplied from the first power voltage supply line ELVDDL to the organic light emitting diode LD in response to a data signal DATA stored in the second capacitor C2 to adjust a light emission amount of the organic light emitting diode LD. That is, the first transistor T1 may control the current supplied to the organic light emitting diode LD in correspondence with a voltage applied to the second node N2.

A first electrode and a second electrode of the second transistor T2 are connected between the data line DLi and a first node N1, respectively. A gate electrode of the second transistor T2 is connected to the third scan line SL3*j*, and when a third scan signal SCAN3 is supplied to the third scan line SL3*j*, the second transistor T2 is turned on to electrically connect the data line DLi and the first node N1 to each other.

A first electrode of the third transistor T3 is connected to the second electrode of the first transistor T1, and a second electrode is connected to the second node N2. In addition, a gate electrode of the third transistor T3 is connected to the second scan line SL2*j*. When a second scan signal SCAN2 is supplied to the second scan line SL2*j*, the third transistor T3 is turned on to electrically connect the second electrode of the first transistor T1 and the second node N2 to each other. In this case, the first transistor T1 may be connected in a diode form.

A first electrode of the fourth transistor T4 is connected to the second node N2 and a second electrode is connected to the initialization voltage supply line VINTL. In addition, a gate electrode of the fourth transistor T4 is connected to the first scan line SL1*j*. When a first scan signal SCAN1 is supplied to the first scan line SL1*j*, the fourth transistor T4 is turned on to supply the initialization voltage VINT to the second node N2. When the scan signal is supplied to the first scan line SL1*j*, the fourth transistor T4 may be turned on to initialize the gate electrode of the first transistor T1 to a voltage of the initialization voltage VINT. Here, the initialization voltage VINT may be set to a voltage lower than the first power voltage ELVDD, for example, a voltage lower than the threshold voltage of the first transistor T1.

A first electrode of the fifth transistor T5 is connected to the reference voltage supply line VREFL, and a second electrode is connected to the first node N1. In addition, a gate electrode of the fifth transistor T5 is connected to the second scan line SL2*j*. According to some example embodiments, the second scan line SL2*j* may extend to be electrically connected to the gate electrode of the third transistor T3 and a gate electrode of the fifth transistor T5. When the second scan signal SCAN2 is supplied to the second scan line SL2*j*, the fifth transistor T5 is turned on to supply the reference voltage VREF to the first node N1. Here, the reference voltage VREF may be set to a voltage higher than a data voltage of white and may be set to a voltage lower than a data voltage of black.

The first electrode of the sixth transistor T6 is connected to the second electrode of the first transistor T1, and a second electrode of the sixth transistor T6 is connected to the anode electrode of the organic light emitting diode LD. In addition, a gate electrode of the sixth transistor T6 is connected to the light emission control line. When the light emission control signal EM is supplied to the light emission control line, the sixth transistor T6 is turned off, and the sixth transistor T6 is turned on in other cases.

A first electrode of the seventh transistor T7 is connected to the anode electrode of the organic light emitting diode LD, and a second electrode is connected to the initialization voltage supply line VINTL. In addition, a gate electrode of the seventh transistor T7 is connected to a first scan line SL1($j$+1). The seventh transistor T7 may be referred to as an initialization transistor for the anode electrode.

The first capacitor C1 is connected between the first node N1 and the first power voltage supply line ELVDDL (e.g., configured to supply a first power supply voltage, or a high voltage). The first capacitor C1 may charge a charge corresponding to the threshold voltage of the first transistor T1.

The second capacitor C2 is connected between the second node N2 and the first node N1. The second capacitor C2 may charge a charge corresponding to the data signal DATA. In addition, the second capacitor C2 may control the voltage of the second node N2 in correspondence with a voltage change amount of the first node N1.

The anode electrode of the organic light emitting diode LD may be connected to the second electrode of the sixth transistor T6, and a cathode electrode may be connected to the second power voltage supply line ELVSSL (e.g., configured to supply a second power supply voltage, or a low voltage (e.g., ground)). According to some example embodiments, the organic light emitting diode LD may be an inorganic light emitting diode or a quantum dot light emitting diode.

According to some example embodiments, the transistors T1 to T7 may be P-type (PMOS) transistors. Channels of the transistors T1 to T7 may be configured of poly silicon. A polysilicon transistor may be a low temperature poly silicon (LTPS) transistor. The polysilicon transistor has a relatively high electron mobility and thus the polysilicon transistor has a relatively fast driving characteristic.

However, the embodiments are not limited to a type of transistors. For example, according to some example embodiments, the transistors T1 to T7 may be N-type (NMOS) transistors. At this time, the channels of the transistors T1 to T7 may be configured of an oxide semiconductor. An oxide semiconductor transistor is capable of a low temperature process and has low charge mobility compared to the polysilicon. Therefore, an amount of a leakage current generated in a turn-off state of the oxide semiconductor transistors is smaller than that of the polysilicon transistors.

According to some example embodiments, the first transistor T1, the second transistor T2, and the fifth to seventh transistors T5 to T7 may be P-type transistors, and the third transistor T3 and the fourth transistor T4 may be N-type transistors. According to some example embodiments, the seventh transistor T7 may be configured of an N-type oxide semiconductor transistor rather than polysilicon. At this time, one of a second scan line SL2($j$+1) and a third scan line SL3($j$+1) may be connected to the gate electrode of the seventh transistor T7, instead of the first scan line SL1($j$+1).

In some embodiments, the display device 1 may include a parasitic capacitor Cp formed by coupling between the second node N2 and a line adjacent to the second node N2.

Next, a driving method of the display device 1 including the pixel PX described above will be described in more detail with reference to FIGS. 4 to 7. However, the following driving method is not limited to the display device 1 including the pixel PX having the above-described circuit diagram, but may also be applied to a display device including a pixel circuit including two capacitors and provided with a reference voltage and an initialization voltage. Additionally, a driving method according to embodiments of the present disclosure may be applied to any other suitable pixel circuit without departing from the spirit and scope of embodiments of the present invention.

Figure 4:
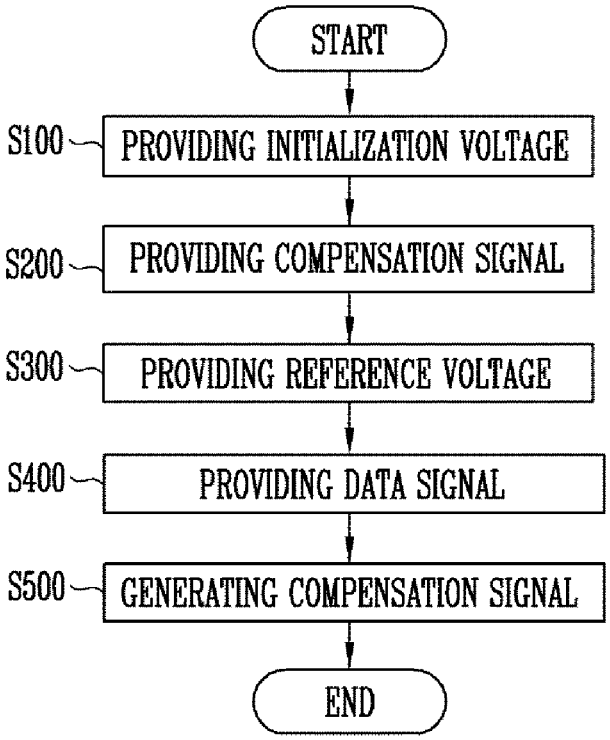
FIG. 4 is a flowchart illustrating a part of a display device driving method according to some example embodiments of the disclosure.
Figure 5:
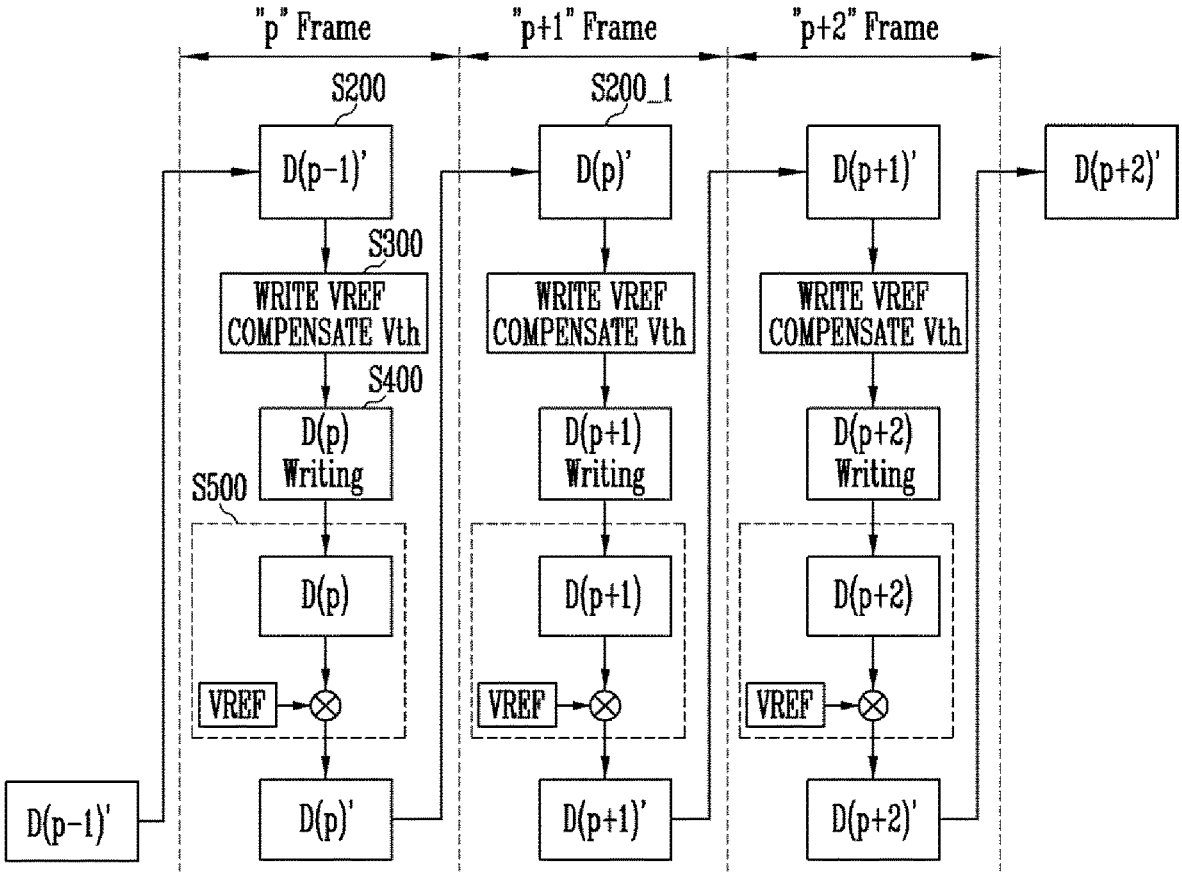
FIG. 5 is a conceptual diagram illustrating a sequence for each frame period in the display device driving method according to some example embodiments of the disclosure.
Figure 6:
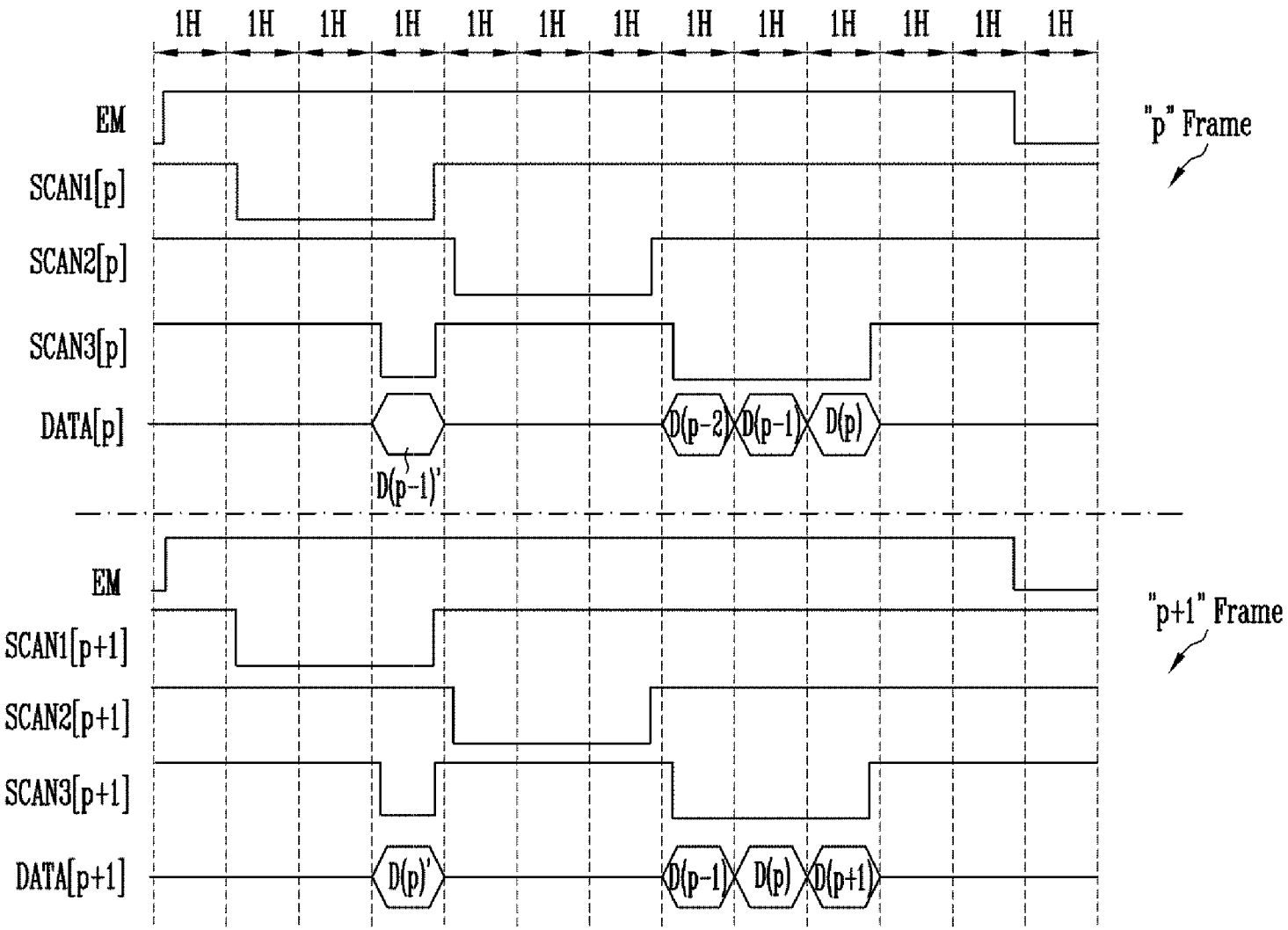
FIG. 6 is a timing diagram illustrating that a light emission control signal, a scan signal, and a data signal are written for each of successive frame periods in the display device driving method according to some example embodiments of the disclosure.

FIG. 4 is a flowchart illustrating a part of a display device driving method according to some example embodiments of the disclosure. FIG. 5 is a conceptual diagram illustrating a sequence for each frame period in the display device driving method according to some example embodiments of the disclosure. FIG. 6 is a timing diagram illustrating that the light emission control signal, the scan signal, and the data signal are written for each of successive frame periods in the display device driving method according to some example embodiments of the disclosure.

Hereinafter, aspects of some example embodiments in which each of the transistors T1 to T7 in the pixel PX is turned on in response to a low logic level signal (e.g., a set or predetermined low logic level signal) (scan-on signal) to the gate electrode as a P-type transistor and is turned off in response to a high logic level (e.g., a set or predetermined high logic level) (scan-off signal) will be described as an example.

The pixel PX may receive the light emission control signal EM of a high logic level to maintain a turn-off state of the organic light emitting diode LD, and may receive the light emission control signal EM of a low logic level to maintain a turn-on state of the organic light emitting diode LD. According to some example embodiments, the light emission control signal EM of the high logic level and the light emission control signal EM of the low logic level may be alternately provided to the pixel PX. A compensation mechanism for compensating for the threshold voltage of the driving transistor may be provided to the pixel PX so that the organic light emitting diode LD has a target luminance when the organic light emitting diode LD is turned on in a next frame period while maintaining the turn-off state of the organic light emitting diode LD in one frame period. That is, FIG. 5 illustrates blocks representing the compensation mechanism in a p-th frame period, a (p+1)-th frame period, and a (p+2)-th frame period which are any successive frame periods, and FIG. 6 illustrates a timing diagram of the p-th frame period and the (p+1)-th frame period. Hereinafter, the driving method of the display device 1 will be described based on the period in which the pixel PX receives the light emission control signal EM of the high logic level.

Referring to FIGS. 4 to 6, the driving method of the display device 1 includes providing a compensation signal (S200), providing a reference voltage (S300), providing a data signal (S400), and generating a compensation signal (S500), in each frame period. In exceptional cases, providing the compensation signal (S200) may be omitted in an initial frame period when the display device 1 is driven. In the present specification, each operation is described as being performed in turn according to the flowchart, but unless the spirit of the disclosure is changed, the operations shown to be performed in succession may be performed simultaneously (or concurrently), the order of each operation may be changed, some operations may be omitted, additional operations may be further included between each operation, or a time at which each operation is performed may overlap at least in part.

Hereinafter, a description will be given with respect to the p-th frame period, but each operation performed in other frame periods including the (p+1)-th frame period and the (p+2)-th frame period are performed substantially the same as that performed in the p-th frame period. Therefore, repetitive descriptions will be omitted.

First, according to some example embodiments, the driving method of the display device 1 may further include providing an initialization voltage (S100) that starts to be performed before operations described above, in each frame period.

In providing the initialization voltage (S100), the fourth transistor T4 may be turned on in response to a first scan signal SCAN[p] of a low logic level, and the initialization voltage VINT may be applied to the second node N2. In addition, the seventh transistor T7 may be turned on in response to the first scan signal SCAN[p] of the low logic level, and the initialization voltage VINT may be applied to the anode electrode of the organic light emitting diode LD. That is, providing the initialization voltage (S100) corresponds to initializing the gate electrode of the driving transistor and the anode electrode of the organic light emitting diode LD to the initialization voltage VINT.

For example, the initialization voltage VINT may be −5 V to 5 V, but the embodiments are not limited thereto.

According to some example embodiments, providing the initialization voltage (S100) may be performed during a period of 3H. Here, 1H is a time corresponding to a pulse width of the horizontal synchronization signal Hsync, and an absolute period may be set differently according to a frame period rate (frame rate, Hz) and the resolution set in the display device 1.

Next, according to some example embodiments, providing the reference voltage (S300) may be performed immediately after (or simultaneously or concurrently) performing providing the initialization voltage (S100) is ended. That is, according to some example embodiments a period during which providing the initialization voltage (S100) and providing the reference voltage (S300) for each frame period are performed may be non-overlapped in time.

Providing the reference voltage (S300) corresponds to charging a charge corresponding to the reference voltage VREF to the second capacitor C2 and compensating for the threshold voltage of the driving transistor. In providing the reference voltage (S300), the fifth transistor T5 may be turned on in response to a second logic scan signal SCAN2 [*p*] of a low logic level, and the reference voltage VREF may be applied to the second node N2. Therefore, a charge as much as the reference voltage VREF may be charged to the second capacitor C2. In addition, the third transistor T3 may be turned on in response to the second scan signal SCAN2 [*p*] of the low logic level, and the second electrode and the gate electrode of the first transistor T1 may be electrically shorted. The reference voltage VREF may be charged to the second electrode and the gate electrode of the first transistor T1 by the second capacitor C2.

According to some example embodiments, providing the reference voltage (S300) may be performed during the same period as providing the initialization voltage (S100). For example, providing the reference voltage (S300) may be performed during a 3H period.

Meanwhile, according to some example embodiments, providing the compensation signal (S200) may be performed after providing the initialization voltage (S100) is started or before providing the reference voltage (S300) is ended. For example, providing the compensation signal (S200) may be performed in at least one period from 1H before providing the initialization voltage (S100) is ended to 1H after providing the reference voltage (S300) is started. According to some example embodiments, providing the compensation signal (S200) is performed from 1H before providing the initialization voltage (S100) is ended until providing the initialization voltage (S100) is ended. That is, providing the compensation signal (S200) may be provided during 1H immediately before providing the compensation signal (S200) is ended.

Providing the compensation signal (S200) corresponds to applying the generated compensation signal to the second node N2 to charge the second capacitor C2 and controlling to the first node N1 and the second node N2 have the same voltage.

According to some example embodiments, in providing the compensation signal (S200), the compensation signal may be applied to the second node N2 through the data line DLi. For example, in providing the compensation signal (S200), the second transistor may be turned on in response to the third scan signal SCAN[p] of the low logic level, and the compensation signal may be provided to the second node N2 through the data line DLi. A method of generating the compensation signal will be described later with reference to FIG. 7.

Performance of providing the compensation signal (S200) is ended before providing the reference voltage (S300) is ended. Therefore, a threshold voltage compensation level of the driving transistor may be maintained at the same level for each frame period, and a target threshold voltage compensation level may be reached for each frame period.

Next, providing the data signal (S400) may be performed immediately after providing the reference voltage (S300) is ended.

Providing the data signal (S400) corresponds to charging a charge corresponding to a data signal DATA[p] to the second capacitor C2 so that the organic light emitting diode LD emits light with a luminance set to a target value.

For example, in providing the data signal (S400), the second transistor T2 may be turned on in response to a third scan signal SCAN[p] of a low logic level, and the data signal DATA[p] may be provided to the second node N2 through the data line DLi.

Meanwhile, in some embodiments, because the second capacitor C2 charges the data signal DATA[p], a data signal provided in previous frame periods may be charged to the gate electrode of the first transistor T1 connected to the second capacitor C2. For example, a data signal D(p−2) provided in a previous-previous frame period (for example, a (p−2)-th frame period), a data signal D(p−1) provided in a previous frame period (for example, a (p−1)-th frame period), and a data signal D(p) provided in a corresponding frame period may be written to the gate electrode of the first transistor T1.

Providing the initialization voltage (S100), providing the reference voltage (S300), and providing the data signal (S400) are performed because independent scan signals SCAN1[*p*], SCAN2[*p*], and SCAN3[*p*], which are applied through separate scan lines (for example, SL1*j*, SL2*j*, and SL3*j*), are provided to different transistors, respectively. Therefore, providing the initialization voltage (S100), providing the compensation signal (S200), providing the reference voltage (S300), and providing the data signal (S400) may be independently performed without effect of performances of the each of other operations.

The driving method of the display device 1 may further include generating the compensation signal (S500) in each frame period. According to some example embodiments, a compensation signal D(p)' provided in providing the compensation signal (S200_1) performed during the (p+1)-th frame period may be generated after providing the data signal (S400) and before providing the compensation signal of the (p+1)-th frame period (S200_1). In the drawing, the provision of the compensation signal D(p)' performed in providing the compensation signal (S200_1) performed during the (p+1)-th frame period is performed after providing the data signal (S400) in the p frame period. However, embodiments according to the present disclosure are not limited thereto.

Hereinafter, generating the compensation signal (S500) will be described in more detail with reference to FIG. 7. The description will be given based on a method of generating the compensation signal D(p)' provided in providing the compensation signal (S200_1) performed during the (p+1)-th frame period.

Figure 7:
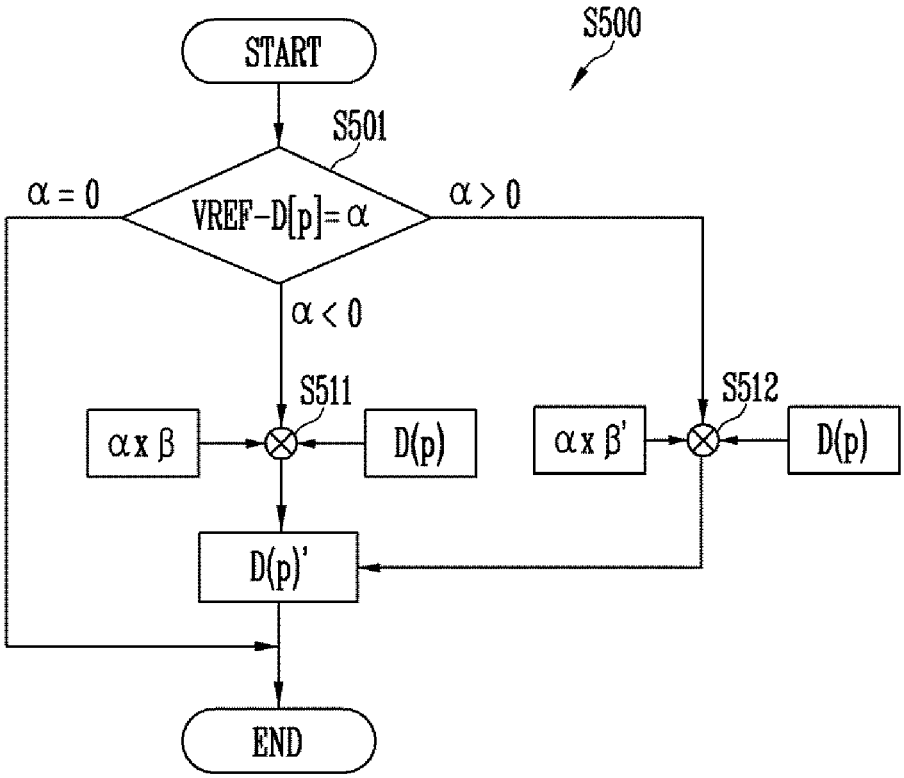
FIG. 7 is an algorithm flowchart illustrating generating a compensation signal in the display device driving method according to some example embodiments.

FIG. 7 is an algorithm flowchart illustrating generating the compensation signal in the display device driving method according to some example embodiments.

Referring to FIG. 7, generating the compensation signal (S500) may include comparing the reference voltage VREF with the data signal D(p) provided in the p-th frame period (S501) and determining the compensation signal (S511). In generating the compensation signal (S500), the compensation signal D(p)' to be provided to the pixel PX during the (p+1)-th frame period may be generated based on the reference voltage VREF and the data signal D(p) provided during the p-th frame period. According to some example embodiments, the reference voltage VREF may be a constant set to a constant value.

First, in comparing the reference voltage VREF with the data signal D(p) provided in the p-th frame period (S501), a difference between the reference voltage VREF and the data signal D(p) provided in the p-th frame period is calculated. For example, a parameter α may be obtained by subtracting the data signal D(p) provided in the p-th frame period from the reference voltage VREF.

In determining the compensation signal (S511), the compensation signal D(p)' to be provided in the (p+1)-th frame period may be determined by calculating the determined compensation value and the data signal D(p) provided in the p-th frame period.

When the parameter α is 0, that is, when the reference voltage VREF and the data signal D(p) provided in the p-th frame period have the same voltage level, it may be determined that the compensation signal D(p)' is not provided during the (p+1)-th frame period in determining the compensation signal (S511).

When the parameter α is a negative value, that is, when the data signal D(p) provided in the p-frame period has a voltage level larger than that of the reference voltage VREF, the compensation signal D(p)' may be determined in correspondence therewith in determining the compensation signal (S511). The compensation signal D(p)' may be obtained by calculating the parameter α and a parameter β. Here, the parameter β may be provided from a first look-up table. The first look-up table may be separate from a second look-up table for threshold voltage compensation.

The compensation signal D(p)' to be provided in the (p+1)-th frame period may be determined by calculating a result (compensation value) of the calculation of the parameter α and the parameter β with the data signal D(p) provided in the p-th frame period. The calculation may include multiplication. According to some example embodiments, the calculation includes multiplication, but embodiments according to the disclosure are not limited thereto, and the compensation signal D(p)' may be determined by various suitable calculations. The compensation signal D(p)' determined in determining the compensation signal (S511) may be provided to the pixel PX in providing the compensation signal (S200_1) performed during the (p+1)-th frame period.

When the parameter α is a positive value, that is, when the data signal D(p) provided in the p-frame period has a voltage level smaller than that of the reference voltage VREF, the compensation signal D(p)' may be determined in correspondence therewith in determining the compensation signal (S511). Similarly, the compensation signal D(p)' may be obtained by calculating the parameter α and a parameter β'. Here, the parameter β' may be provided from the first look-up table.

The compensation signal D(p)' to be provided in the (p+1)-th frame period may be determined by calculating a result (compensation value) of the calculation of the parameter α and the parameter β' with the data signal D(p) provided in the p-th frame period. Similarly, the calculation may include multiplication. The compensation signal D(p)' determined in determining the compensation signal (S511) may be provided to the pixel PX in providing the compensation signal (S200_1) performed during the (p+1)-th frame period.

As a comparative example, under an assumption that a separate compensation signal D(p)' is not provided, at a time point at which providing the initialization voltage (S100) is ended, the gate electrode of the first transistor may have a voltage level of the initialization voltage VINT, and the first node N1 may have a voltage level of the data signal D(p−1) provided in the previous frame period (for example, the (p−1)-th frame period). When providing the initialization voltage (S100) is ended and providing the reference voltage (S300) is started, the gate electrode of the first transistor T1 may be transited to a voltage level corresponding to a difference between the first power voltage ELVDD and the threshold voltage from the voltage level of the initialization voltage VINT, and the first node N1 may be transited to the voltage level of the reference voltage VREF from the voltage level of the data signal D(p−1) provided in the previous frame period. According to the voltage level of the data signal D(p−1) provided in the previous frame period, the first node N1 may have a difference in voltage level for each frame period. For example, a voltage amount of the first node N1 may correspond to a value obtained by multiplying the difference between the reference voltage VREF and the data signal D(p−1) provided in the previous frame period by a proportional constant K. Here, the proportional constant K may be applied to Equation 1 below:

$$K=C2/(C2+Cp) \quad \text{Equation 1}$$

where C2 is the capacitance of the second capacitor, and Cp is the capacitance of the parasitic capacitor.

Therefore, the voltage of the gate electrode of the first transistor T1 may be changed for each frame period due to a coupling effect of the parasitic capacitor Cp in providing the reference voltage (S300).

According to some example embodiments of the disclosure, before providing the reference voltage (S300) is ended for each frame period, the compensation signal D(p)' generated based on the data signal (for example, D(p)) provided in the previous frame period (for example, the p-th frame period) and the reference voltage VREF is provided in 'providing the compensation signal (for example, S200_1)', and thus a voltage deviation of the first node N1 and the gate electrode of the first transistor T1 may be reduced. In other words, a voltage between the first node N1 and the second node N2, that is, a voltage between both ends of the second capacitor C2, before providing the data signal (for example, (D(p+1)) may be set to be extremely close to zero, by providing the compensation signal D(p)'. In the present specification, the term "extremely close to a certain value" means a case "it may be regarded as substantially the same as the corresponding value".

Next, a display device driving method according to some example embodiments will be described. Hereinafter, descriptions of the same or similar components as those of FIGS. 1 to 7 may be omitted for brevity, and the same or similar reference numerals are used.

Figure 8:
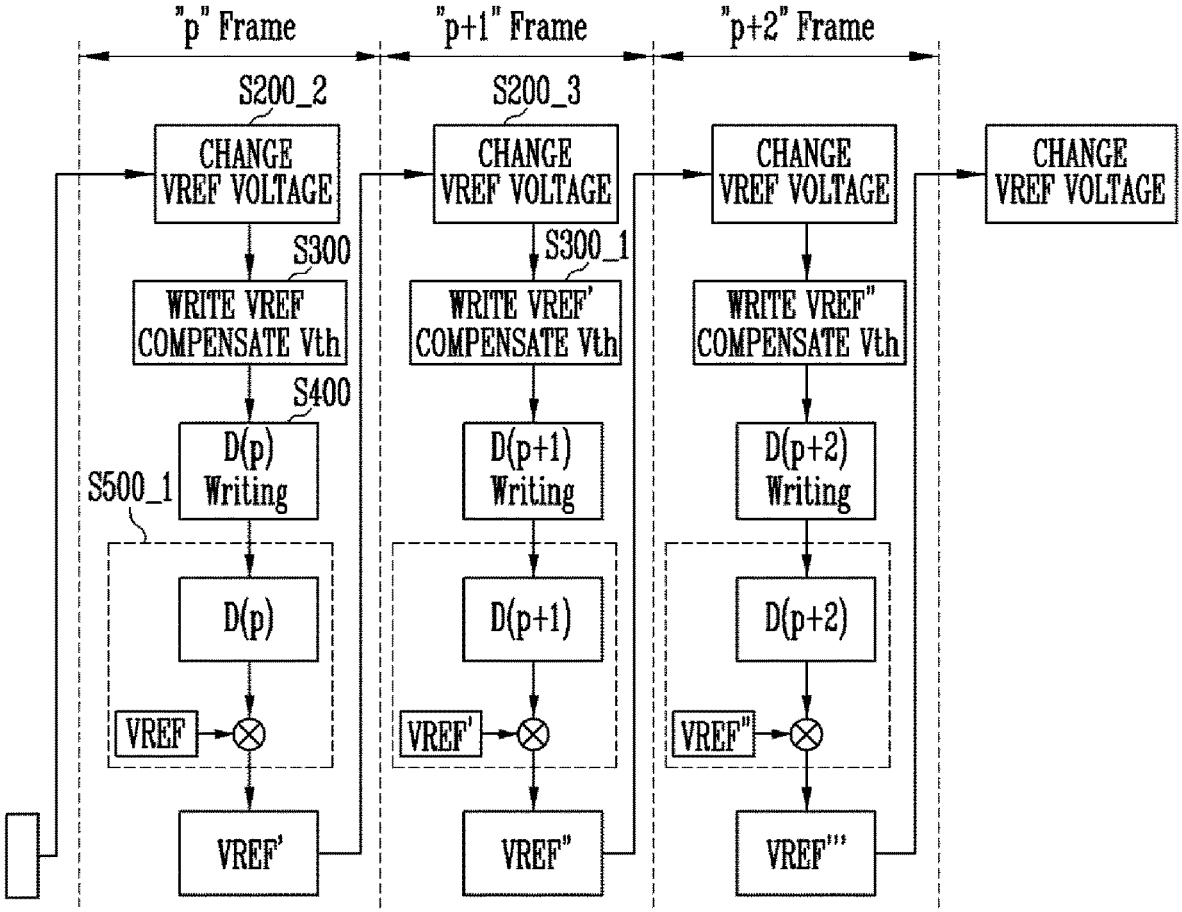
FIG. 8 is a conceptual diagram illustrating a sequence for each frame period in a display device driving method according to some example embodiments.
Figure 9:
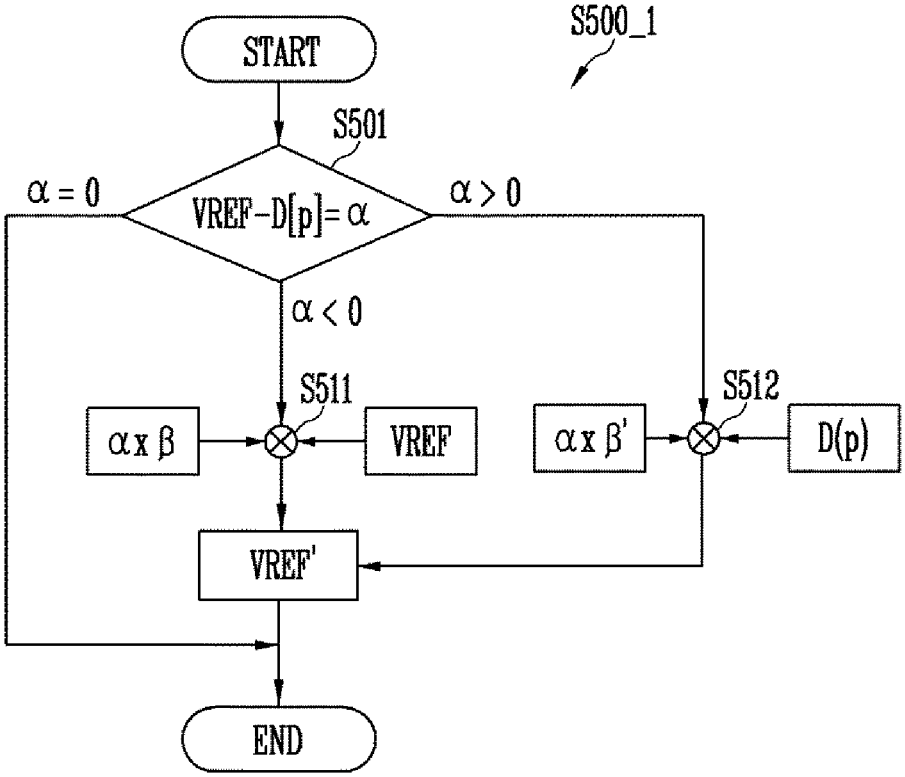
FIG. 9 is an algorithm flowchart illustrating generating the compensation signal in the embodiment of FIG. 8.

FIG. 8 is a conceptual diagram illustrating a sequence for each frame period in a display device driving method according to some example embodiments. FIG. 9 is an algorithm flowchart illustrating generating the compensation signal in the embodiment of FIG. 8.

Referring to FIGS. 8 and 9, in the display device driving method according to some example embodiments, providing the compensation signal (S200_2) may change a voltage level of the reference voltage VREF for each frame period as the compensation signal. According to some example embodiments, the voltage level of the reference voltage VREF provided for each frame period may be different.

As the compensation signal provided in one frame period (for example, the (p+1)-th frame period), a reference voltage VREF' changed from the reference voltage VREF of the previous frame period (for example, the p-th frame period) may be provided. That is, according to some example embodiments, providing the compensation signal (S200_2) may correspond to changing the reference voltage VREF. In other words, after changing the reference voltage VREF, providing the reference voltage (S300_1) may be performed. In addition, generating the compensation signal (S500_1) may correspond to determining the reference voltage VREF' to be changed.

The voltage level of the reference voltage VREF may be adjusted by the reference voltage controller 74 in the power supply 70.

In providing the compensation signal (changing the reference voltage VREF), the reference voltage VREF' changed from the previous frame period may be applied to the second node N2 in providing the reference voltage to charge the second capacitor C2, and the first node N1 and the second node N2 may be controlled to have the same voltage level.

The reference voltage VREF' changed as the compensation signal to be provided in the (p+1)-th frame period may be determined by various methods.

As an example, the changed reference voltage VREF' as the compensation signal to be provided in the (p+1)-th frame period may be determined by calculating a parameter to the reference voltage VREF provided in the p-th frame period.

Generating the compensation signal (S500_1) may include comparing the reference voltage VREF provided in the p-th frame period with the data signal D(p) provided in the p-th frame period and determining the compensation signal (S511). The reference signal VREF' to be provided in the (p+1)-th frame period may be determined by determining the compensation signal (S511).

First, in comparing the reference voltage VREF provided in the p-th frame period and the data signal D(p) provided in the p-th frame period, a difference between the reference voltage VREF provided in the p-th frame period and the data signal D(p) provided in the p-th frame period is calculated. For example, the parameter $\alpha$ may be obtained by subtracting the data signal D(p) provided in the p-th frame period from the reference voltage VREF.

When the parameter $\alpha$ is 0, that is, when the reference voltage VREF and the data signal D(p) provided in the p-th frame period have the same voltage level, it may be determined that the compensation signal is not provided during the (p+1)-th frame period in determining the compensation signal (S511).

When the parameter $\alpha$ is a negative value, that is, when the data signal D(p) provided in the p-frame period has a voltage level larger than that of the reference voltage VREF, the reference voltage VREF' changed in correspondence therewith may be determined in determining the compensation signal (S511). The reference voltage VREF' to be changed may be obtained by calculating the parameter $\alpha$ and the parameter $\beta$. Here, the parameter $\beta$ may be provided from a first look-up table. The first look-up table may be separate from a second look-up table for threshold voltage compensation.

The reference voltage VREF' to be provided as the compensation signal in the (p+1)-th frame period may be determined by calculating a result of the calculation of the parameter $\alpha$ and the parameter $\beta$ with the reference voltage provided in the p-th frame period. The calculation may include multiplication. The reference voltage VREF' determined in determining the compensation signal (S511) may be provided to the pixel PX in providing the reference voltage (300_1) performed during the (p+1)-th frame period.

When the parameter $\alpha$ is a positive value, that is, when the data signal D(p) provided in the p-frame period has a voltage level smaller than that of the reference voltage VREF, the reference voltage VREF' to be changed in correspondence therewith may be determined in determining the compensation signal (S511). Similarly, the compensation signal may be obtained by calculating the parameter $\alpha$ and a parameter $\beta'$. Here, the parameter $\beta'$ may be provided from the first look-up table.

The reference voltage VREF' to be provided as the compensation signal in the (p+1)-th frame period may be determined by calculating a result of the calculation of the parameter $\alpha$ and the parameter $\beta'$ with the reference voltage provided in the p-th frame period. The calculation may include multiplication. The reference voltage VREF' determined in determining the compensation signal (S511) may be provided to the pixel PX in providing the reference voltage (300_1) performed during the (p+1)-th frame period.

Because the changed voltage values VREF, VREF', and VREF" are provided to the pixel in providing the reference voltage (S300 and S300_1) for each frame period, a voltage deviation of the first node N1 and the gate electrode of the first transistor T1 may be reduced. In other words, a voltage between the first node N1 and the second node N2, that is, a voltage between both ends of the second capacitor C2 may be set to be extremely close to zero, by changing the voltage values VREF, VREF', and VREF" for each frame period.

As another example, the change reference voltage VREF' as the compensation signal to be provided in the (p+1)-th frame period may be determined as the voltage level charged in the second node N2 in the p-th frame period.

For example, the voltage level of the change reference voltage VREF' to be provided in the (p+1)-th frame period may be determined to be equal to the voltage level of the data signal D(p) provided in the p-th frame period.

In this manner, the voltage deviation between the first node N1 and the gate electrode of the first transistor T1 may be reduced. In other words, a voltage between the first node N1 and the second node N2, that is, a voltage between both ends of the second capacitor C2 may be set to be extremely close to zero, by providing the compensation signal.

Figure 10:
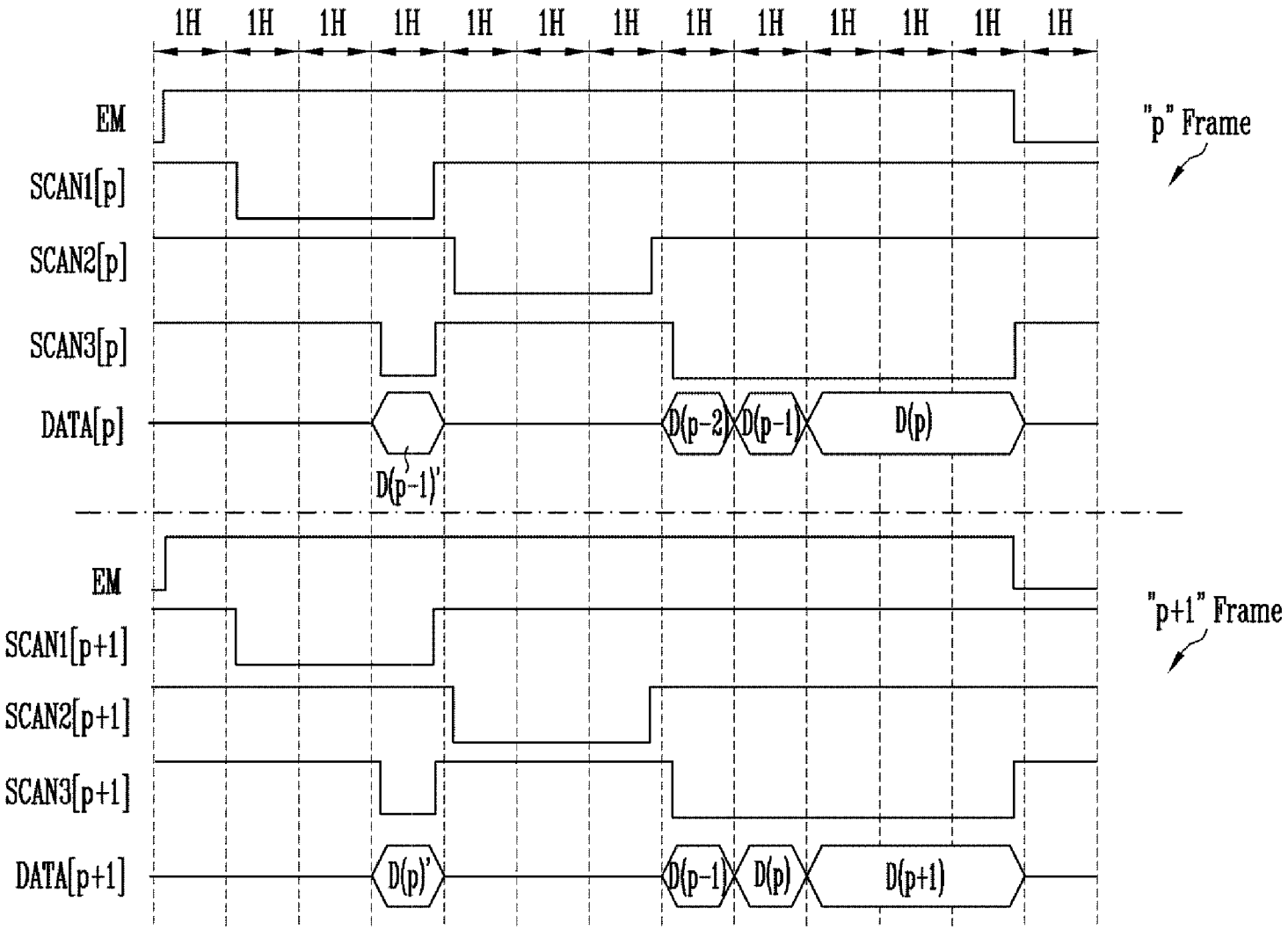
FIG. 10 is a timing diagram illustrating that the light emission control signal, the scan signal, and the data signal are written for each of successive frame periods in the display device driving method according to some example embodiments.

FIG. 10 is a timing diagram illustrating that the light emission control signal, the scan signal, and the data signal are written for each of successive frame periods in the display device driving method according to some example embodiments.

Referring to FIG. 10, the display device driving method according to the present embodiment is different from the embodiment of FIG. 6, in that a period in which the data signal DATA[p] is provided to each pixel PX is different from a period in which the reference voltage VREF is provided and a period in which the initialization voltage VINT is provided, in each frame period.

According to some example embodiments, the period in which the data signal DATA[p] is written to each pixel PX may be longer than the period in which the reference voltage VREF is written and the period in which the initialization voltage VINT is written, in each frame period. That is, a period of providing the data signal (S400) may be longer than a period of providing the reference voltage (S300) for each frame period. For example, the period in which the initialization voltage VINT is written to each pixel PX may be 3H or less, and the period in which the data signal DATA[p] is written may be 5H or more.

In other words, a scan-on period of the second transistor T2 for writing the data signal DATA[p] may be longer than a scan-on period of the third to fifth transistors T3 to T5 for writing the reference voltage VREF or the initialization voltage VINT.

The period in which the data signal DATA[p] is provided, the period in which the reference voltage VREF is written, and the period in which the initialization voltage VINT is written may be independently controlled due to a structure of the pixel PX including the two capacitors.

Therefore, a time for writing the data signals D(p) and D(p+1) to each pixel PX for each frame period may be sufficiently secured.

Figure 11:
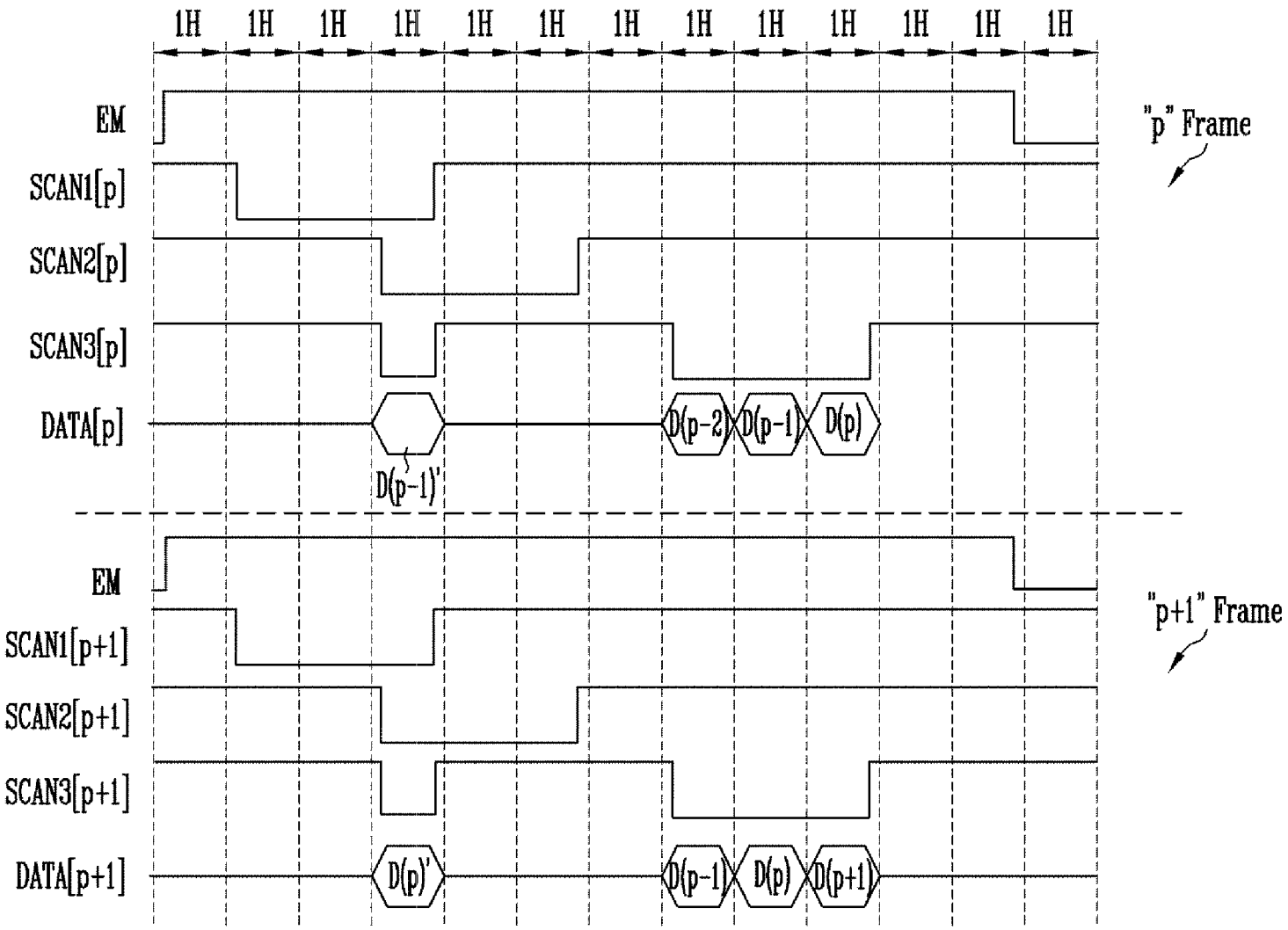
FIG. 11 is a timing diagram illustrating that the light emission control signal, the scan signal, and the data signal are written for each of successive frame periods in the display device driving method according to some example embodiments.

FIG. 11 is a timing diagram illustrating that the light emission control signal, the scan signal, and the data signal are written for each of successive frame periods in the display device driving method according to some example embodiments.

Referring to FIG. 11, the display device driving method according to the present embodiment is different from the embodiment of FIG. 6, in that the period in which the reference voltage VREF is provided and the period in which the initialization voltage VINT is provided overlap at least a portion. For each frame period, providing the initialization voltage (S100) and providing the reference voltage (S300) may overlap at least a part in time.

According to some example embodiments, first the initialization voltage VINT may be started to be provided, and the reference voltage VREF may be started to be provided before providing the initialization voltage VINT is ended. After providing the initialization voltage VINT is ended, providing the reference voltage VREF may be ended. For example, the period in which the reference voltage VREF is provided and the period in which the initialization voltage VINT is provided may overlap during about 1H.

In other words, the scan-on period of the third to fifth transistors T3 to T5 for writing the reference voltage VREF or the initialization voltage VINT may overlap at least a part.

According to some example embodiments, the compensation signals D(p−1)' and D(p)' may be provided during the period in which the reference voltage VREF is provided and the period in which the initialization voltage VINT overlap. However, a time during which the compensation signals D(p−1)' and D(p)' are provided is not limited thereto.

Figure 12:
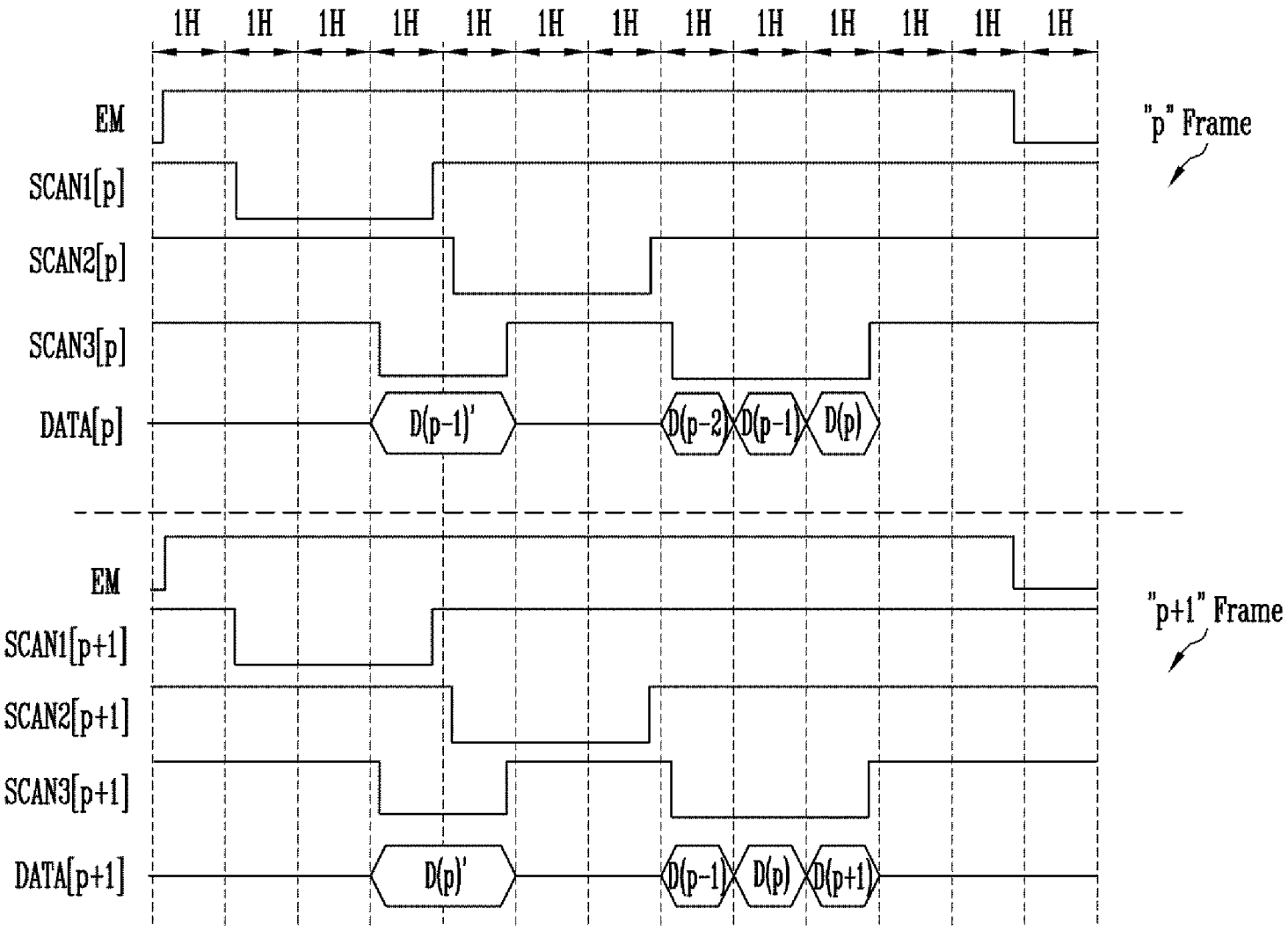
FIGS. 12 and 13 are timing diagrams illustrating that the light emission control signal, the scan signal, and the data signal are written for each of adjacent frame periods to one pixel in the display device according to some example embodiments.
Figure 13:
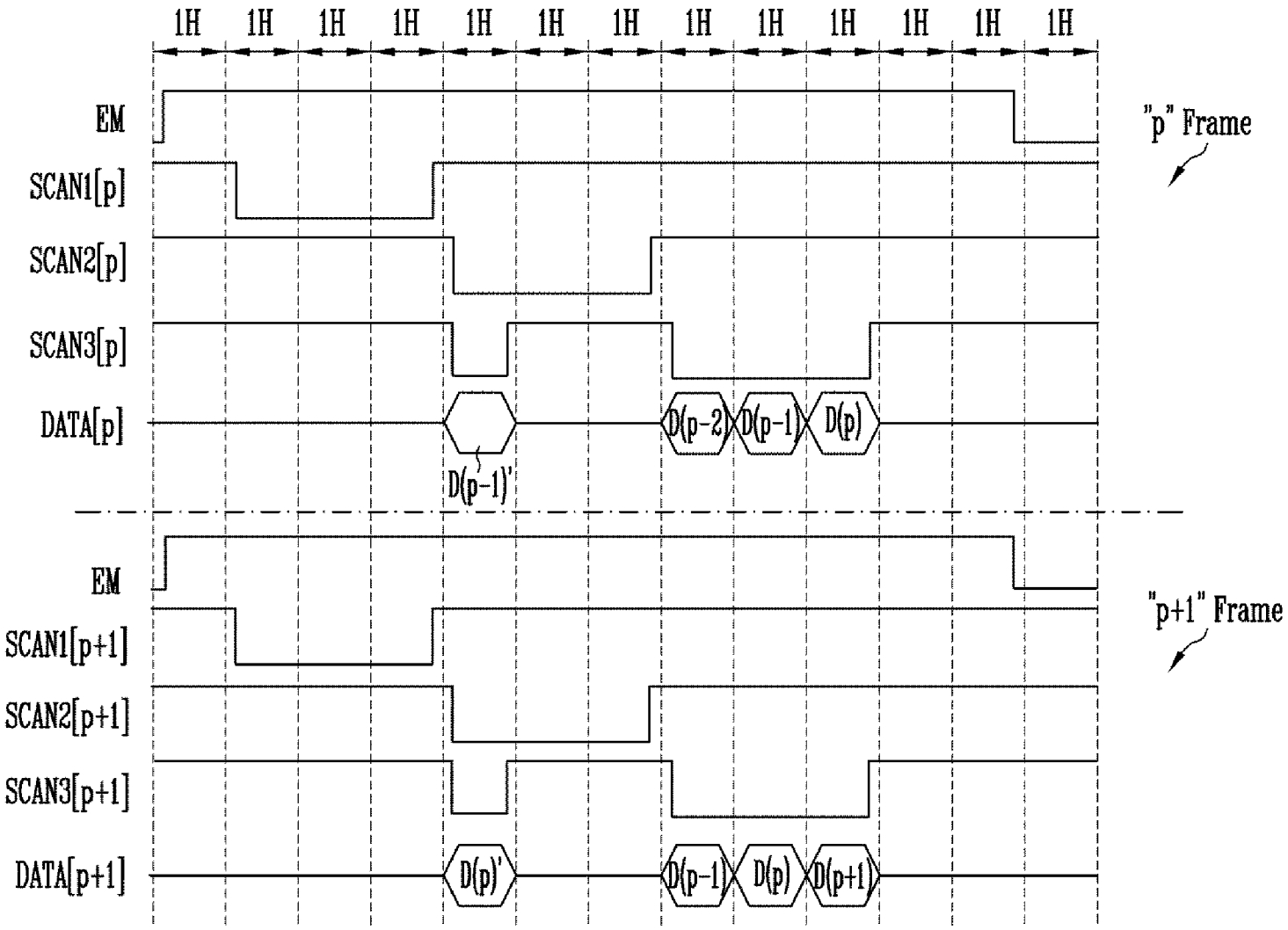

FIGS. 12 and 13 are timing diagrams illustrating that the light emission control signal, the scan signal, and the data signal are written for each of adjacent frame periods to one pixel in the display device according to some example embodiments.

Referring to FIGS. 12 and 13, the display device driving method according to the present embodiment is different from the embodiment of FIG. 6, in that the time during which the compensation signals D(p−1)' and D(p)' are written are different from each other.

As illustrated in FIG. 12, the compensation signals D(p−1)' and D(p)' may be started to be provided before providing the initialization voltage VINT is ended, and the provision of the compensation signals D(p−1)' and D(p)' may be ended after the reference voltage VREF is started to be provided.

In addition, as illustrated in FIG. 13, the compensation signals D(p−1)' and D(p)' may be started to be provided when the reference voltage VREF is provided, and the provision of the compensation signals D(p−1)' and D(p)' may be ended before provision of the reference voltage VREF is ended.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

Although the embodiments of the disclosure have been described with reference to the accompanying drawings, it will be understood by those skilled in the art to which the disclosure pertains that the embodiments may be implemented in other specific forms without changing the technical spirit and essential features of the disclosure. Therefore, it should be understood that the embodiments described above are illustrative and are not restrictive in all aspects.

What is claimed is:

1. A display device driving method comprising:

providing a reference voltage for compensating a threshold voltage of a driving transistor in a pixel; and providing a data signal to the pixel, wherein providing the reference voltage, and providing the data signal to the pixel are performed in a first frame period, and a second frame period successive to the first frame period, wherein the display device driving method further comprises providing a compensation signal generated by comparing a data signal with a reference voltage provided in a previous frame period of each frame period to the pixel before providing the reference voltage is ended.

2. The display device driving method according to claim 1, further comprising:

providing, during each frame period, an initialization voltage to the pixel to initialize a voltage level of a gate electrode of the driving transistor.

3. The display device driving method according to claim 2, wherein providing the initialization voltage, providing the reference voltage, and providing the data signal are sequentially started, in each frame period.

4. The display device driving method according to claim 3, wherein providing the compensation signal is performed after providing the initialization voltage is started, in each frame period.

5. The display device driving method according to claim 4, wherein providing the initialization voltage and providing the reference voltage are non-overlapped in time, in each frame period.

6. The display device driving method according to claim 1, wherein a length of time during which providing the reference voltage is performed and a length of time during which providing the data signal is performed are different from each other, in each frame period.

7. The display device driving method according to claim 1, wherein the data signal and the compensation signal are provided through a same data line.

8. The display device driving method according to claim 1, wherein a process of generating the compensation signal provided in the second frame period comprises:

comparing the reference voltage provided in the first frame period with a magnitude of the data signal; and determining a compensation signal to be provided in the second frame period.

9. The display device driving method according to claim 8, wherein determining the compensation signal comprises determining the compensation signal by calculating the data signal provided in the first frame period and a compensation value.

10. The display device driving method according to claim 9, wherein the compensation value is determined by calculating a first parameter provided from a look-up table and a second parameter generated by comparing the reference voltage with the magnitude of the data signal, and the calculation includes multiplication.

11. The display device driving method according to claim 1, wherein the pixel comprises:

a pixel circuit connected to a first power voltage supply line and a second power voltage supply line configured to provide a power voltage, a plurality of scan lines configured to provide a scan signal, a data line configured to provide the data signal, and a reference voltage supply line configured to provide the reference voltage; and an organic light emitting diode connected to the pixel circuit.

12. The display device driving method according to claim 11, wherein the pixel circuit includes a plurality of transistors and a plurality of capacitors.

13. The display device driving method according to claim 12, wherein one capacitor among the plurality of capacitors charges a gate electrode of the driving transistor to a voltage corresponding to the data signal.

14. The display device driving method according to claim 13, wherein a voltage level of both electrodes of the one capacitor is the same after providing the compensation signal.

15. The display device driving method according to claim 12, wherein the plurality of transistors comprise:

a first transistor having a source or drain electrode connected between the first power voltage supply line and an anode electrode of the organic light emitting diode, and a gate electrode connected to a second node; and a second transistor having a source or drain electrode connected between the data line and a first node, and a gate electrode connected to a first scan line among the plurality of scan lines, and the plurality of capacitors comprises:

a first capacitor connected between the first power voltage supply line and the first node; and a second capacitor connected between the first node and the second node.

16. The display device driving method according to claim 15, wherein the plurality of transistors further comprise a third transistor having a source or drain electrode connected to the first node and the reference voltage supply line, and a gate electrode connected to a second scan line among the plurality of scan lines.

17. A display device driving method comprising:

providing, during a first frame period, a reference voltage for compensating a threshold voltage of a driving transistor in a pixel;

providing, during the first frame period, a data signal to the pixel through a data line; and generating a compensation signal provided to the pixel in a second frame period successive to the first frame period by comparing the reference voltage provided in the first frame period with the data signal.

18. The display device driving method according to claim 17, wherein the compensation signal is received in the second frame period, and a voltage between both ends of a capacitor connected to a gate electrode of the driving transistor becomes zero.

19. The display device driving method according to claim 17, further comprising:

providing the compensation signal through the data line before providing the reference voltage in the second frame period is ended, after generating the compensation signal.

20. A display device driving method comprising:

providing, in a first frame period, a reference voltage for compensating a threshold voltage of a driving transistor in a pixel;

providing, in the first frame period, a data signal to the pixel through a data line; and determining a voltage level of the reference voltage provided to the pixel in a second frame period successive to the first frame period by comparing the reference voltage provided in the first frame period with the data signal, wherein a voltage level of the reference voltage provided in the first frame period and a voltage level of the reference voltage provided in the second frame period are different from each other.

* * * * *